US007424809B2

(12) United States Patent
Son et al.

(10) Patent No.: US 7,424,809 B2
(45) Date of Patent: Sep. 16, 2008

(54) WASHING MACHINE WITH MELODY GENERATING ASSEMBLY

(75) Inventors: Kweon Son, Changwon-si (KR); Seong Sik Kim, Seoul (KR); Tae In Park, Changwon-si (KR)

(73) Assignee: LG Electronics Inc., Seoul (KR)

( * ) Notice: Subject to any disclaimer, the term of this patent is extended or adjusted under 35 U.S.C. 154(b) by 643 days.

(21) Appl. No.: 10/928,248

(22) Filed: Aug. 30, 2004

(65) Prior Publication Data

US 2005/0086979 A1 Apr. 28, 2005

(30) Foreign Application Priority Data

Oct. 23, 2003 (KR) ..... 10-2003-0074070
Oct. 23, 2003 (KR) ..... 10-2003-0074071

(51) Int. Cl.
*D06F 39/00* (2006.01)

(52) U.S. Cl. ..... 68/12.27

(58) Field of Classification Search ..... 68/12.02, 68/12.23, 12.27
See application file for complete search history.

(56) References Cited

U.S. PATENT DOCUMENTS 5,392,032 A * 2/1995 Kline et al. ..... 340/604
6,678,215 B1 * 1/2004 Treyz et al. ..... 368/10
6,742,208 B2 * 6/2004 Broker ..... 8/158
2005/0016228 A1 * 1/2005 Bergemann et al. ..... 68/12.12

FOREIGN PATENT DOCUMENTS

WO WO 03029549 A1 * 4/2003

* cited by examiner

*Primary Examiner*—Joseph L Perrin
(74) *Attorney, Agent, or Firm*—Ked & Associates LLP

(57) ABSTRACT

A control method of a washing machine enables the output of a plurality of melodies indicative of any one of a plurality of operational states of the washing machine. The method of controlling the washing machine includes the steps of assigning at least one audio signal according to a specific operational state of the washing machine among a plurality of operational states, monitoring the specific operational state of the washing machine, and outputting the at least one audio signal according to the specific operational state.

8 Claims, 4 Drawing Sheets

WASHING MACHINE WITH MELODY GENERATING ASSEMBLY

This application claims the benefit of Korean Application Nos. P2003-074070 and P2003-074071, both filed on Oct. 23, 2003, which are hereby incorporated by reference.

BACKGROUND OF THE INVENTION

1. Field of the Invention

The present invention relates to washing machines, and more particularly, to a washing machine control method and a washing machine using the same, in which an audio circuit is variously utilized in conjunction with specific washing machine operations.

2. Discussion of the Related Art

Generally speaking, a washing machine is an apparatus for washing laundry by composite reactions of, for instance, friction between the laundry and a water current due to, for example, a pulsator; friction between the laundry and an inner surface of a tub, including an agitator; and the cleaning power of a detergent mixed with the water. A general washing machine is shown in FIG. 1.

Referring to FIG. 1, a cover 2 and display 3 are provided to an upper part of an outer case 1 and a base 4 is coupled to a lower part of the outer case 1. An outer tub 5 is installed within the outer case 1 and a damper 6 provides elasticity to the outer tub 5. An inner tub 7 is installed within the outer tub 5 and a pulsator 8 is installed within the inner tub 7. A drive motor 9 generating a rotational force and a clutch 12 transferring the rotational force are installed under the outer tub 5. The clutch 12 transfers the rotational force to a dewatering shaft 10 to rotate the inner tub 7 or to a washing shaft 11 to rotate the pulsator 8.

Typically, the washing machine as described above is further provided with an audio generator, such as a piezoelectric buzzer, for outputting a simple mechanical sound to notify a user of an operational malfunction or the completion of an operational cycle. Such an audio generator, however, is limited to the output of a single type of sound, which is often unpleasant to the ear. Furthermore, it is difficult to control a buzzer to distinguish the completion or operational status of one among a variety of washing machine operations.

SUMMARY OF THE INVENTION

Accordingly, the present invention is directed to a washing machine control method and a washing machine using the same that substantially obviate one or more of the problems due to limitations and disadvantages of the related art.

An object of the present invention, which has been devised to solve the foregoing problem, lies in providing a washing machine control method, by which various audio sounds, such a musical melody, are generated according to an operational status of the washing machine.

Another object of the present invention lies in providing a washing machine control method, by which a specific operation is easily distinguishable and recognizable to the user.

Another object of the present invention lies in providing a washing machine control method to provide the user with an audio indication of a specific operation that is pleasant to the ear.

Another object of the present invention lies in providing a washing machine control method to provide the user with a selectable audio indication of a specific operation.

A further object of the present invention lies in providing a washing machine suitable for use with the above method.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, a method of controlling a washing machine includes the steps of assigning at least one audio signal according to a specific operational state of the washing machine among a plurality of operational states, monitoring the specific operational state of the washing machine, and outputting the at least one audio signal according to the specific operational state. The audio signal output according to the specific operational state may be selectable.

The plurality of operational states may include at least one of completion of wash cycle, completion of a rinse cycle, completion of a dewatering cycle, completion of a drying cycle, a specific completion point of wash cycle, a specific completion point of a rinse cycle, a specific completion point of a dewatering cycle, a specific completion point of a drying cycle, a specific water level, a specific water temperature, a specific air temperature, a specific water hardness, deletion of a detergent, a specific detergent level, depletion of a fabric softener, a specific fabric softener level, a failure of a wash cycle, a failure of a rinse cycle, a failure of a dewatering cycle, a failure of a drying cycle, a specific rotational speed of a motor, a motor failure, a specific rate of water supply, a water supply failure, and a drain failure. A plurality of audio signals may be assigned to one or more of the plurality of operational states.

The method may include a step of storing the at least one audio signal in a memory of the washing machine. The method may also include the steps of assigning a first display indication for the at least one audio signal, displaying the first display indication of the stored at least one audio signal, and selecting one of the at least one audio signal for output. Herein, the displayed first display indications may include volume and output period controls for the selected audio signal.

The method may include the steps of respectively assigning a second display indication for each of the plurality of operational states of the washing machine, displaying the second display indications, and selecting at least one of the displayed second display indications corresponding to a specific operational state to be monitored.

Herein, the displayed second display indications may include volume and output period controls for the selected audio signal. The method may include steps of downloading an audio signal from a peripheral device, and storing the downloaded audio signal in the memory. Herein, the at least one audio signal may be a musical melody. The musical melody may be selectable according to genre. The at least one audio signal may be a multiple-chord melody.

In another aspect of the present invention, a washing machine includes a main assembly including a microcomputer for controlling the washing machine and a buzzer drive circuit for generating a buzzer sound, a melody generating assembly storing a plurality of melodies to generate one of a plurality of the melodies according to a cycle or state of the washing machine, and a sound setup unit changing to set up the buzzer sound and the melodies. The washing machine may also include a connector connecting the main assembly and the melody generating assembly to each other.

The melody generating assembly may provide a list of the stored melodies to a user. The sound setup unit may include a buzzer sound selecting key, a melody selecting key, a melody changing key, and a volume control key. Herein, the melody generating assembly may download to store the melodies from an external device. The melody generating assembly may include a melody generating circuit providing the corresponding melody according to the cycle or state of the washing machine, a speaker outputting the corresponding melody, and a partition separating the melody generating circuit and the speaker from each other. Herein, the microcomputer may monitor the cycle and state of the washing machine and provides a signal for informing the cycle and state of the washing machine to the melody generating assembly.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE PREFERRED EMBODIMENT

Reference will now be made in detail to the preferred embodiment of the present invention, examples of which are illustrated in the accompanying drawings. Throughout the drawings, like elements are indicated using the same or similar reference designations where possible.

Figure 1:
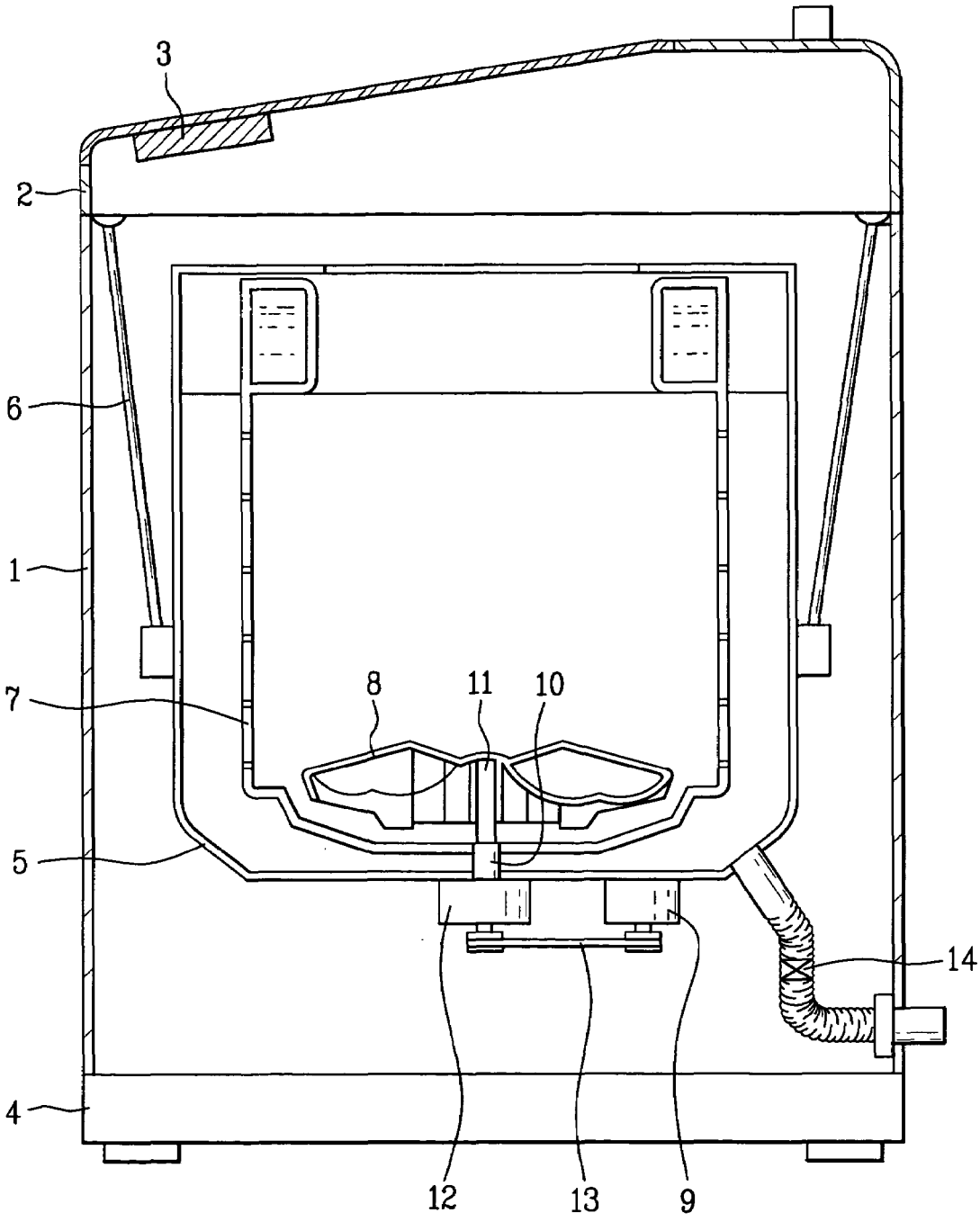
FIG. 1 is a schematic cross-sectional diagram of a general washing machine.
Figure 2:
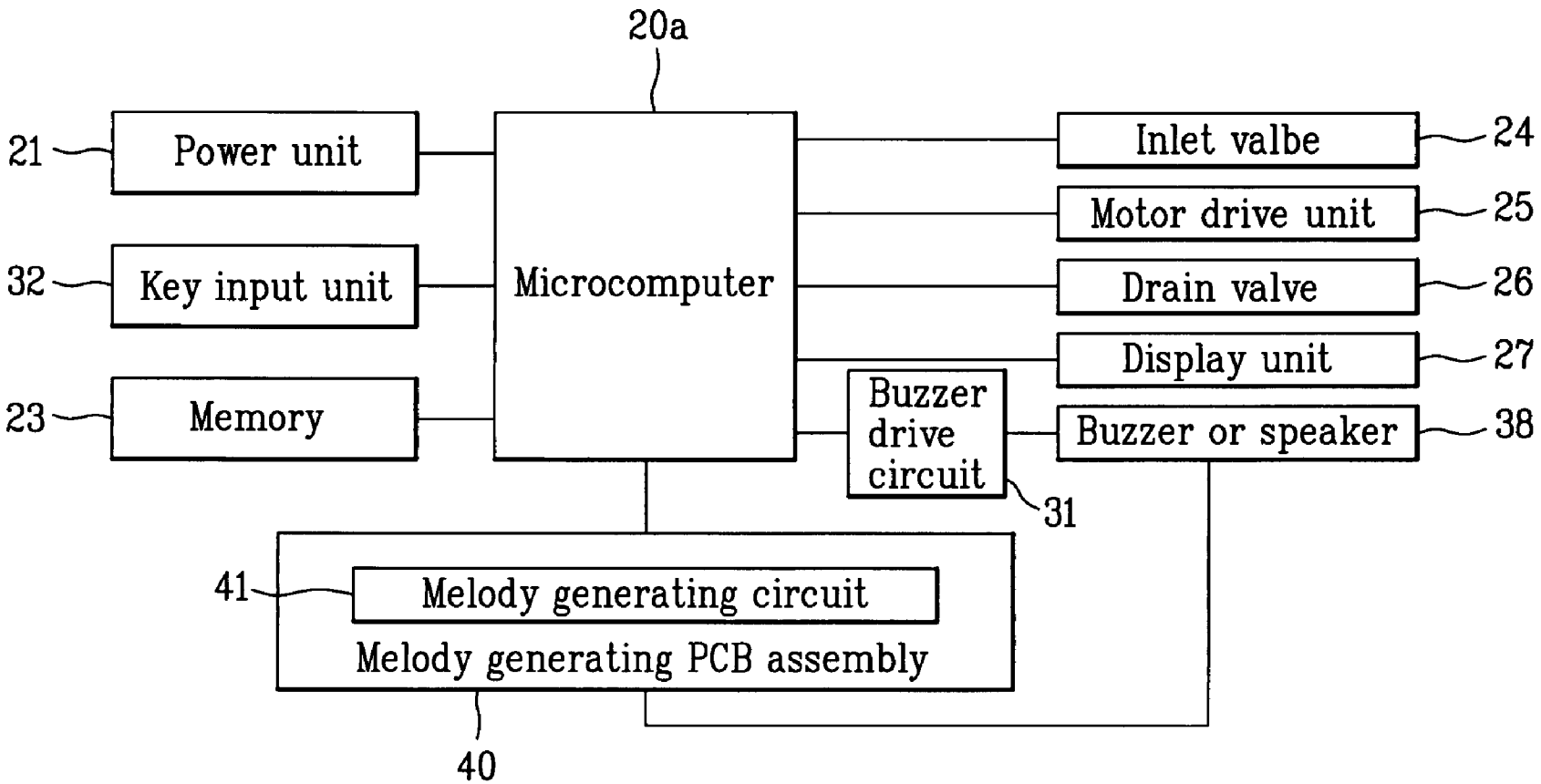
FIG. 2 is a block diagram of a washing machine according to the present invention.

FIG. 2 is a block diagram of a washing machine according to the present invention. Referring to FIG. 2, a microcomputer 20*a* controls a washing machine according to a selected washing course or selected washing option. A power unit 21 converts AC voltage inputted from outside to DC voltage to provide the DC voltage to the microcomputer 20*a* and other elements of the washing machine. A key input unit 32 receives to provide a user's command to the microcomputer 20*a*. A memory 23 stores programs associated with washing for a washing time, rinsing time, dewatering time, and the like according to a type and amount of laundry. An inlet valve 24 supplies water to the washing machine according to a control of the microcomputer 20*a*. A motor drive unit 25 drives a motor ('9' in FIG. 1) according to a control of the microcomputer 20*a*. A drain valve 26 discharges the water according to a control of the microcomputer 20*a*. A display unit 27 displays a washing-associated indication or message according to a control of the microcomputer 20*a*. A buzzer or speaker 38 generates a sound for informing an error or completion of washing, and a buzzer drive circuit 31 drives the buzzer or speaker 38. A melody generating unit 40 generates various sounds such as a melody according to a control of the microcomputer 20*a*. The melody generating unit 40 has a shape of a printed circuit board (PCB) assembly and includes a melody generating circuit 41 storing to generate melodies, which are close to original sounds such as 16-chords, 40-chords, and the like, of various kinds of musical genres such as pop music, jazz, classic, etc.

Figure 3:
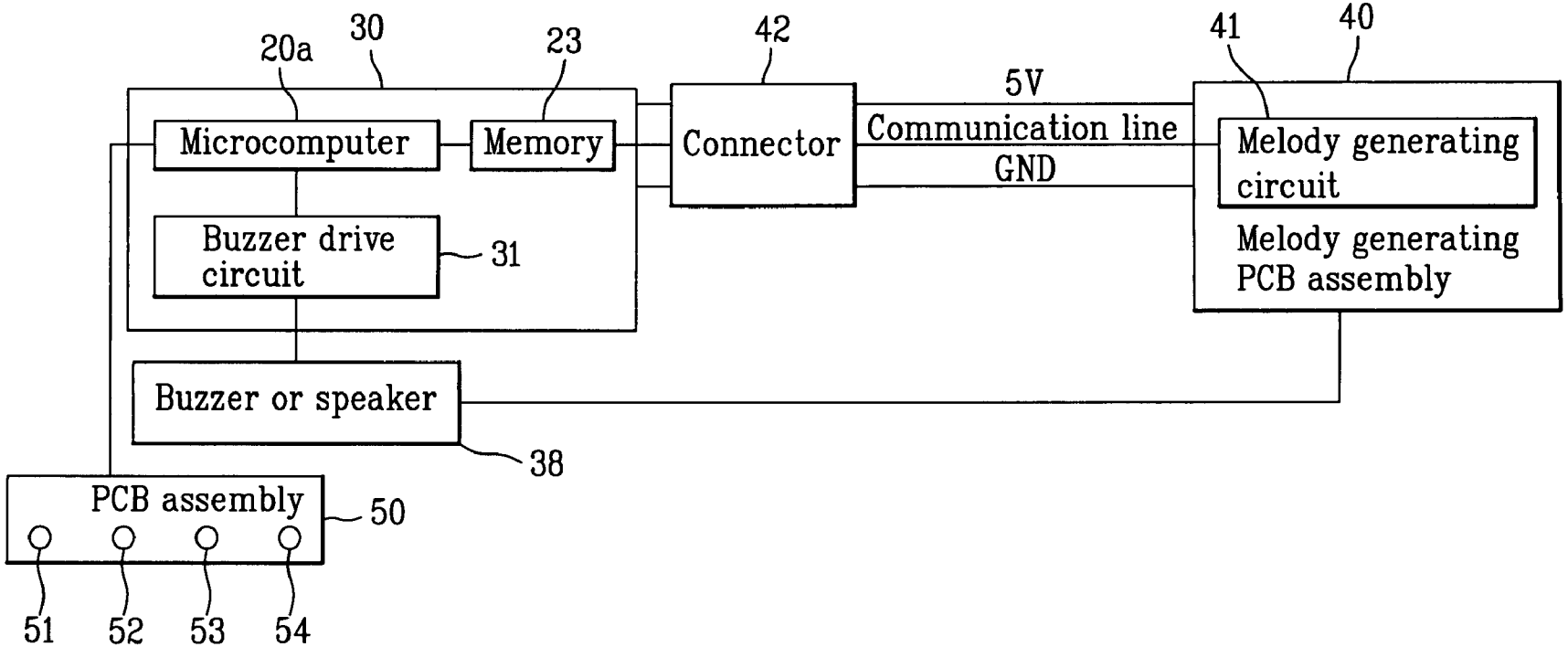
FIG. 3 is a block diagram of PCB assemblies in a washing machine according to the present invention.

FIG. 3 is a block diagram of PCB assemblies in a washing machine according to the present invention. Referring to FIG. 3, a washing machine according to the present invention includes a main PCB assembly 30, a melody generating PCB assembly, and a sound setup PCB assembly 50. The main PCB assembly 30 includes a microcomputer 20*a*, a memory 23, and a buzzer drive circuit 31. The microcomputer 20*a* monitors a cycle, state, and the like and then provides a signal for informing the cycle or state of the washing machine to the melody generating PCB assembly 40. For instance, if a washing, rinsing, or dewatering cycle is completed, the microcomputer 20*a* provides a signal for informing the completion of the washing, rinsing, or dewatering cycle or a signal for informing a malfunction of the washing machine such as motor failure, water supply failure, drain failure, and the like to the melody generating PCB assembly 40. The melody generating PCB assembly 40 then outputs a melody corresponding to the cycle or state of the washing machine monitored by the microcomputer 20*a*.

The melody generating PCB assembly 40 is connected to the main PCB assembly 30 via a connector 42. The melody generating PCB assembly 40 is detachable from the main PCB assembly via the connector 42. A communication line for signal exchange is connected between the main PCB assembly 30 and the melody generating PCB assembly 40. Moreover, the melody generating PCB assembly 40 is applicable to a full-automatic washing machine, a drum type washing machine, and other home appliances.

The melody generating PCB assembly 40 is connected to an external device such as a personal computer or server and then downloads melody-associated data from the external device. The melody generating PCB assembly 40 stores the downloaded data in a memory of its own. And, the melody generating PCB assembly 40 displays a list of the stored melodies so that a user can select one of the melodies.

The sound setup PCB assembly 50 includes a buzzer sound setup key 51, a melody setup key 52, a melody changing key 53, and a volume control key 54. Once a user presses the buzzer sound setup key 51, the microcomputer 20*a* controls the buzzer drive circuit 31 to output a single sound according to the cycle or state of the washing machine. If a user presses the melody setup key 52, the microcomputer controls the melody generating circuit 41 to output a melody according to the cycle or state of the washing machine. A user enables to set up melodies, which will be outputted according to cycles or states of the washing machine, respectively, using the melody setup key 52. For instance, a user enables to set up the melodies using the melody setup key 52 in a manner that a first melody is outputted in case of completion of a washing cycle or a second melody is outputted in case of occurrence of the washing machine. Moreover, a user enables to change a melody using the melody changing key 53. And, a user enables to adjust volumes of buzzer sound and melody. The sound setup PCB assembly 50, as shown in FIG. 3, includes four keys 51, 52, 53, and 54. Yet, the construction of the sound setup PCB assembly 50 can be modified. For instance, the sound setup PCB assembly 50 may further include a key for adjusting an output time of the buzzer sound or melody.

Figure 4:
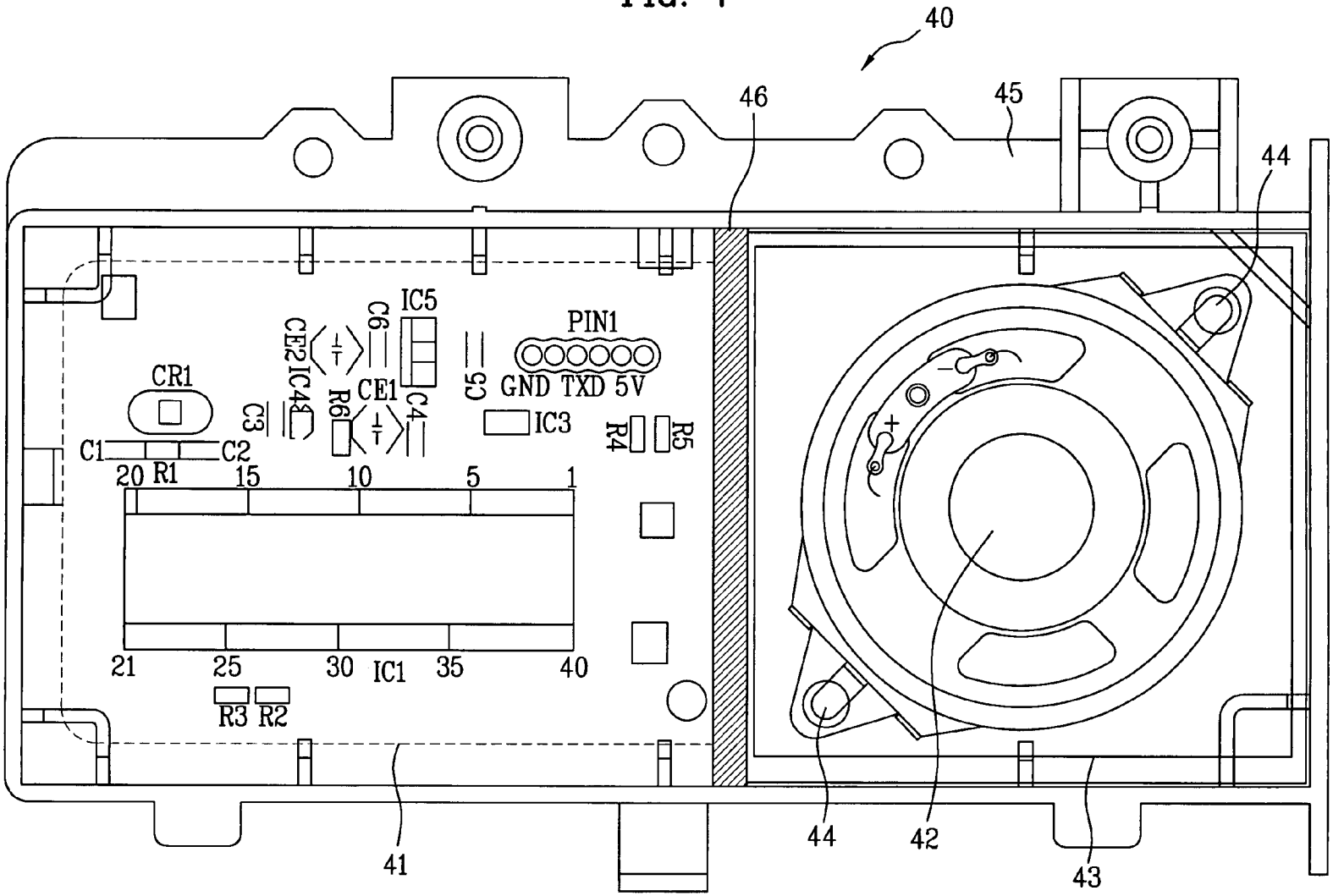
FIG. 4 is a detailed diagram of a melody generating assembly according to one embodiment of the present invention.

FIG. 4 is a detailed diagram of a melody generating assembly according to one embodiment of the present invention.

Referring to FIG. 4, a melody generating PCB assembly 40 includes a melody generating circuit 41, a speaker 42, an insulator support part 45 supporting the melody generating circuit 41 and the speaker 42. A transparent film is coated on the melody generating circuit 41 to protect the circuit 41 from water or humidity. Coating is not performed on the speaker 42 to output sounds. In order to separate the melody generating circuit 41 from the speaker 42, a partition 46 is installed between the melody generating circuit 41 and the speaker 42. Moreover, a sounding board 43 for resonance is installed over the speaker 42 to amplify the sounds outputted from the speaker 42.

Accordingly, the melodies are set up or outputted according to the cycles or states of the washing machine according to the present invention, a user just listens to the corresponding melody of the washing machine to recognize the corresponding cycle or state of the washing machine with ease. And, the present invention enables to provide various kinds of music to a user as well.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A washing machine, comprising:

a main assembly including a microcomputer for controlling the washing machine and a buzzer drive circuit for generating a buzzer sound;

a melody generating assembly detachably connected to the main assembly that downloads a plurality of melodies from an external device and stores the plurality of melodies in a memory, and that generates at least one of the plurality of the melodies according to a cycle or state of the washing machine; and a sound setup unit, wherein the sound setup unit allows a user to cause the washing machine to output either the buzzer sound or one of the plurality of melodies according to a cycle or state of the washing machine.

2. The washing machine of claim 1, further comprising a connector connecting the main assembly and the melody generating assembly to each other.

3. The washing machine of claim 1, wherein the melody generating assembly provides a list of the stored melodies to a user.

4. The washing machine of claim 1, wherein the sound setup unit comprises a buzzer sound selecting key, a melody selecting key, a melody changing key, and a volume control key.

5. The washing machine of claim 1, the melody generating assembly comprising:

a melody generating circuit that generates a melody according to the cycle or state of the washing machine;

a speaker outputting the corresponding melody; and a partition separating the melody generating circuit and the speaker from each other.

6. The washing machine of claim 1, wherein the microcomputer monitors the cycle and state of the washing machine and provides a signal for informing the cycle and state of the washing machine to the melody generating assembly.

7. The washing machine of claim 1, wherein the sound setup unit allows a user to select a melody to be played when a particular cycle of a washing machine begins or ends.

8. The washing machine of claim 1, wherein the sound setup unit allows a user to select a first melody to be played when a first cycle of the washing machine begins or ends, and a second melody to be played when a second cycle of the washing machine begins or ends.

* * * * *